US005281285A

United States Patent [19]

Marquardt

[11] Patent Number: 5,281,285

[45] Date of Patent: Jan. 25, 1994

[54] TRI-TITANIUM ALUMINIDE ALLOYS HAVING IMPROVED COMBINATION OF STRENGTH AND DUCTILITY AND PROCESSING METHOD THEREFOR

[75] Inventor: Brian J. Marquardt, Loveland, Ohio

[73] Assignee: General Electric Company, Cincinnati, Ohio

[21] Appl. No.: 905,709

[22] Filed: Jun. 29, 1992

[51] Int. Cl.[5] ..... C22C 14/00

[52] U.S. Cl. ..... 148/670; 148/421; 148/671; 420/418

[58] Field of Search ..... 148/670, 671, 421; 420/418

[56] References Cited

U.S. PATENT DOCUMENTS

| | | | |
|---|---|---|---|
| 2,880,087 | 3/1959 | Jaffee et al. | 75/175.5 |
| 4,292,077 | 9/1981 | Blackburn et al. | 75/175.5 |
| 4,716,020 | 12/1987 | Blackburn et al. | 420/418 |
| 4,788,035 | 11/1988 | Gigliott, Jr. et al. | 420/420 |
| 5,032,357 | 7/1991 | Rowe | 420/418 |

FOREIGN PATENT DOCUMENTS

| | | | |
|---|---|---|---|
| 2274829 | 11/1990 | Japan | C22C 14/00 |
| 8901052 | 2/1989 | World Int. Prop. O. | C22C 14/00 |

OTHER PUBLICATIONS

Sixth World Conference on Titanium, Jun. 6–9, 1988, "Proceedings–Part II", by P. Lacombe, R. Tricot and G. Beranger, p. 1103, "Fracture Mechanisms in Titanium Aluminide Intermetallics".

Intermetallic Phases—Materials Developments and Prospects, by Gerhard Sauthoff, p. 337.

*Primary Examiner*—Upendra Roy

*Attorney, Agent, or Firm*—Jerome C. Squillaro; Carmen Santa Maria

[57] ABSTRACT

Tri-titanium aluminide alloys are preferably deformed and heat treated below the beta transus temperature of the alloys to produce an improved combination of mechanical properties, specifically elevated temperature yield strength and creep resistance, and room temperature ductility and toughness. A preferred composition consists essentially of, in atomic percent, 24.5% aluminum, 12.5% niobium, 1.5% molybdenum, balance titanium.

11 Claims, 2 Drawing Sheets

TRI-TITANIUM ALUMINIDE ALLOYS HAVING IMPROVED COMBINATION OF STRENGTH AND DUCTILITY AND PROCESSING METHOD THEREFOR

The United States Government has certain rights in this invention, pursuant to contracts F33657-90-C-2245, F33615-89-C-5615 and F33615-85-C-5167.

BACKGROUND OF THE INVENTION

This invention relates to tri-titanium aluminide alloys containing beta stabilizers, particularly molybdenum and niobium, which have an improved combination of tensile yield strength and creep-rupture strength at elevated temperatures, and room temperature ductility and fracture toughness.

Titanium alloys have found widespread use in aircraft gas turbine engines. Such alloys are attractive because they provide a useful combination of light weight, high strength and resistance to elevated temperatures. Early attempts to extend the capabilities of titanium alloys included studies of alloys based on the binary intermetallic compound $Ti_3Al$. This early work included research in the Ti-Al-Nb system from about 9 to about 30 atomic percent aluminum (about 5 to about 17.5 weight percent aluminum) and about 8 to about 17 atomic percent niobium (about 15 to about 30 weight percent niobium). These compositions yield alloys having the alpha-2 phase as a major constituent. In the present discussion, alloys having chemical compositions based on the binary intermetallic $Ti_3Al$ but containing other alloying elements are termed tri-titanium aluminides. The term alpha-2 means the ordered hexagonal phase having the $DO_{19}$ structure characteristic of the $Ti_3Al$ composition. However, alloys termed alpha-2 alloys may contain small amounts of other phases, such as retained beta (which is isomorphous with the high temperature allotrope of elemental titanium) or a metastable orthorhombic phase. Unless otherwise indicated, all compositions described herein are given in atomic percent.

This early work indicated that although tri-titanium aluminides containing niobium have excellent creep-rupture strength and oxidation resistance, room temperature ductility and fracture toughness were too low to allow the alloys to be useful as engineering alloys.

More recent work has been done to develop tri-titanium aluminide intermetallic alloys for use in turbine engine applications. One of the problems with these tri-titanium aluminides continues to be the lack of room temperature ductility, with elongation in room temperature tensile tests frequently less than about 2 percent. Such low elongation values can adversely affect ultimate tensile strength, because the material fractures shortly after yielding.

Efforts have been made to develop tri-titanium aluminides into engineering alloys. Jaffee, U.S. Pat. No. 2,880,087, broadly discloses titanium aluminide alloys containing from 0.5–50 weight percent niobium, vanadium, and other elements and mixtures thereof, but lacks teachings on the proportions of vanadium and niobium as well as any particular criticality within the disclosed range.

Blackburn et al., U.S. Pat. No. 4,292,077, describe a titanium alloy having an aluminum content in the range of 24–27 percent, 11–16 percent niobium, balance titanium. Blackburn teaches the substitution of Vanadium for a portion of the niobium. Blackburn also teaches that solutioning and cooling from above the beta transus results in improved tensile strength and ductility, whereas solutioning and cooling from below the beta transus produces low ductility and low creep life. While additions of other elements, including molybdenum, are mentioned, Blackburn indicates that there are no benefits from such additions. Clearly, Blackburn does not appreciate the benefits of the substitution of molybdenum for niobium in improving the heat treatment response and strength of tri-titanium aluminide alloys, which is a critical part of the present invention.

Blackburn et al., U.S. Pat. No. 4,716,020, discloses a tri-titanium aluminide alloy having improved ductility containing molybdenum from 0.5 to 4 percent, niobium plus molybdenum from 11 to 16 percent and aluminum from 25 to 27 percent, and optionally, up to about 4 percent vanadium substituted for niobium. Blackburn fails to recognize the overall importance of molybdenum in achieving desirable response to heat treatment, particularly with alloy compositions containing less than 25 percent aluminum. Blackburn teaches solutioning the alloy above the beta transus to achieve the improved properties.

Gigliotti et al., U.S. Pat. No. 4,788,035, provides an alloy having improved tensile strength, ductility and rupture life due to the reduction in aluminum content and the addition of tantalum, coupled with optional additions of vanadium and niobium. However, Gigliotti fails to recognize the benefits of molybdenum in achieving further. improvements in properties in this class of alloys.

In a 1988 article, Ward et al. disclosed forging below the beta transus in order to vary the volume fraction of primary alpha-2, followed by heat treatment below the forging temperature. However, that publication fails to disclose processing temperatures and also fails to appreciate the significance of molybdenum in providing improvements in either properties or response to heat treatment.

In a 1989 article, Sauthoff mentions the benefits of niobium additions and very fine grain size in $Ti_3Al$-type alloys to improve ductility, but provides no teaching regarding specific amounts of niobium additions and no teaching regarding methods for refining grain size.

An object of the present invention is to provide a tri-titanium aluminide alloy having an improved combination of mechanical properties, such as improved elevated temperature tensile strength and creep-rupture resistance without sacrificing room temperature ductility and fracture toughness, or, alternatively, improved room temperature ductility and fracture toughness without sacrificing elevated temperature tensile strength and creep-rupture resistance.

Another object of the present invention is to provide a method for processing tri-titanium aluminide alloys to achieve the improved combination of room temperature ductility and fracture toughness and elevated temperature tensile strength and creep-rupture resistance.

Yet another object of the present invention is to provide a combination of a tri-titanium aluminide alloy and a method for processing that alloy such that improved room temperature ductility and fracture toughness can be achieved with easily implemented thermal treatment cycles.

SUMMARY OF THE INVENTION

The present invention discloses a tri-titanium aluminide alloy composition having an improved combination of room temperature ductility and toughness, and high temperature tensile strength and creep resistance, together with a processing method for achieving those desirable mechanical properties. In its preferred composition, this tri-titanium aluminide alloy consists essentially of from about 22.5 percent to less than about 25 percent aluminum, at least about 10 percent to about 14.5 percent niobium, about 1 percent to about 2 percent molybdenum, and the balance essentially titanium. The term "balance essentially titanium" is used herein to indicate that the balance of the alloy is comprised of titanium and small amounts of impurities and incidental elements, which in character and/or amount do not adversely affect the advantageous aspects of the alloy. Holding the aluminum level below 25 percent is beneficial to ductility of the alloy, while a molybdenum level of at least 1 percent provides retention of creep resistance and tensile strength which might otherwise be lost by reducing the aluminum content. Further, the molybdenum improves the response of the alloy to thermal treatment.

The present invention also discloses a method for processing a tri-titanium aluminide alloy, referred to as sub-beta transus processing, to produce a mixed microstructure including a primary alpha-2 phase, Widmanstatten platelets and, typically, retained beta. The process comprises the steps of heating the alloy to a first temperature below the beta transus temperature of the alloy; while holding the alloy at about this first temperature, thermomechanically working the alloy sufficiently so that the primary alpha-2 phase is evenly distributed about the microstructure and the microstructure is refined; heating the worked alloy to a second temperature above the first temperature but below the beta transus temperature and holding the alloy at this temperature for a period of time sufficient to retain about 2 percent to about 20 percent of the primary alpha-2 phase, and cooling the worked alloy from the second temperature at a cooling rate sufficient to produce a mixed microstructure of primary alpha-2 phase, fine alpha-2 Widmanstatten platelets and, typically, retained beta. This sub-beta transus processing produces the desired microstructure having improved room temperature ductility, and creep resistance, fracture toughness and a tensile strength level substantially equivalent to material heat treated above the beta transus. Although the sub-beta transus processing can be used to improve the yield strength and the room temperature ductility of other tri-titanium aluminide-alloys, the processing of the alloy of the present invention produces significant improvements in ductility over existing alloys. The present invention also discloses working or thermal treatment above the beta transus, but under such controlled conditions as to avoid disadvantages sometimes encountered in prior art methods.

Other features and advantages will be apparent from the following more detailed description of the invention, taken in conjunction with the accompanying drawings, which will illustrate, by way of example, the principles of the invention.

DETAILED DESCRIPTION OF THE INVENTION

Pursuant to the present invention, tri-titanium aluminide intermetallic alloys having an improved combination of elevated temperature yield strength, creep resistance, room temperature ductility and toughness are provided. A method for processing such alloys to produce a particularly useful microstructure is also provided. When such alloys are processed according to this method, a particularly desirable combination of properties is achieved, particularly when the aluminum content is maintained below about 25 percent.

In the context of the present invention this concept of a desirable combination of properties is very important. For example, in order to maximize the creep resistance of a particular metal or alloy, the metallurgical structure of that metal or alloy generally has relatively large grains. However, in order to maximize room temperature ductility and toughness, the structure generally has much smaller grains. Thus, for applications which require both elevated temperature creep resistance and room temperature ductility and toughness, such as in components of aircraft gas turbine engines, it is necessary to make some sort of compromise in properties. The essence of the present invention is directed toward such compromise, so that the combination of properties in tri-titanium aluminides is maximized, without undue sacrifice of any individual property.

Figure 2:
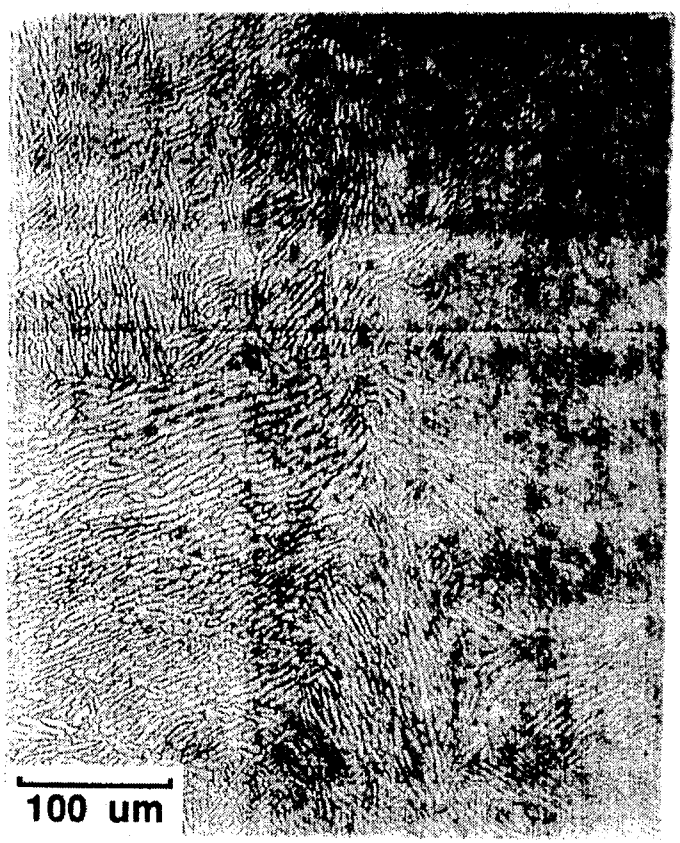
FIG. 2. Photomicrograph of a section of a billet of Ti-24.5Al-10.5Nb-1.5Mo alloy. Billet was slowly cooled from temperature above beta transus. Microstructure comprises colonies of alpha-2 phase within outlines of large prior beta grains. Magnification 200×.
Figure 1:
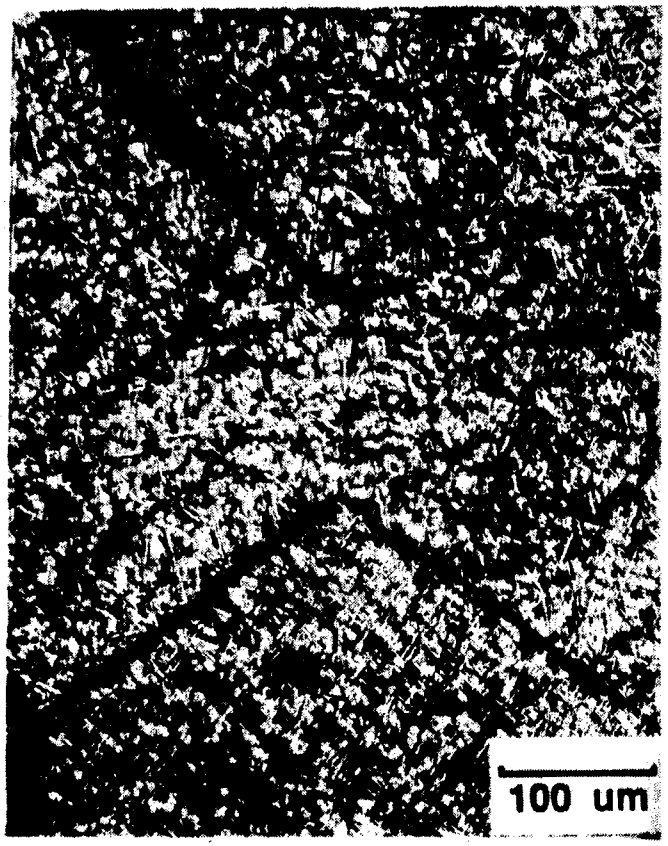
FIG. 1. Photomicrograph of Ti-24.5Al-14.5Nb-1.5Mo alloy heat treated at 1120° C. (above beta transus), quenched into salt bath at 900° C., held at 900° C. for 30 minutes, air cooled. Microstructure comprises fine Widmanstatten structure within outlines of large prior beta grains. Magnification 200×.

In tri-titanium aluminides of the type contemplated in the present invention, the beta phase is stable at temperatures above the beta transus. On very rapid cooling or quenching from the beta solutioning temperature, the brittle metastable B2 structure is formed. On slightly slower cooling from the beta solutioning temperature a very fine Widmanstatten structure such as that shown in FIG. 1 is formed. This structure typically provides good tensile strength, but low ductility. On very slow cooling from the beta solutioning temperature, large colonies of alpha-2 are formed within the beta grains and at beta grain boundaries; the resulting structure, shown in FIG. 2, results in both low ductility and low strength. Cooling at intermediate rates yields Widmanstatten structures that typically exhibit a desirable combination of properties. However, it is frequently difficult to reliably achieve such intermediate cooling rates in normal manufacturing operations. In addition, many tri-titanium aluminides are vulnerable to recrystallization and/or rapid grain growth during thermomechanical processing or heat treatment above the beta transus. It is believed that in a structure such as that shown in FIG. 1, which was formed from large beta grains, the large beta grain size contributes to the low ductility of that structure.

As indicated above, the Widmanstatten structure provides a useful combination of properties. However, in the course of work leading to the present invention it became apparent that controlling the microstructure of tri-titanium aluminides would greatly facilitate achieving a desirable combination of properties, namely, high temperature tensile strength and creep resistance, and low temperature ductility and toughness. It was found that combining a carefully chosen range of alloy compositions with a novel sequence of processing operations can result in the required control of the microstructure and consequent desirable combination of mechanical properties.

In tri-titanium aluminide alloys, molybdenum, niobium, tantalum, vanadium and tungsten are beta stabilizers. Such elements permit the beta phase to be stable at lower temperatures and retard the transformation from beta to alpha-2, thereby allowing the beta phase to transform to a fine alpha-2 Widmanstatten microstructure at moderate cooling rates. The cooling rates needed to achieve the desired structure are slower, and more readily reproducible, than those required for tri-titanium aluminides without beta stabilizers. Also, tri-titanium aluminides containing beta stabilizers contain a certain amount of retained beta phase at room temperature. It was found that a small amount of retained beta phase, on the order of about 10 percent, improves low temperature ductility and toughness in these alloys. It has been found that molybdenum is particularly effective when used with other beta stabilizers in achieving the useful effects of beta stabilization.

The prior art teaches that the ductility of tri-titanium aluminide alloys increases as the amount of aluminum in the alloy is decreased and the amount of niobium is increased. Conversely, these changes in alloy composition decrease the creep resistance of the alloys. The prior art also teaches that vanadium, molybdenum or tantalum, or some combination thereof, may be advantageously substituted for part of the niobium. The nominal compositions of some prior art preferred alloys are Ti-25.5Al-13Nb, Ti-25Al-9Nb-2V, and Ti-25Al-10Nb-3V-1Mo.

In developing the alloys of the present invention it was found that the aluminum content must be maintained below about 25 percent; the aluminum content is preferably greater than about 22.5 percent. This amount of aluminum, when considered in conjunction with the amounts of niobium and molybdenum, and the processing methods discussed below, provides a useful balance between alloys which have good ductility but reduced creep resistance (at lower aluminum levels) and those which have good creep resistance but reduced ductility (at higher aluminum levels). The preferred aluminum content is about 24.5 percent.

Increasing the niobium content of tri-titanium aluminides increases the toughness, ductility and tensile strength of the alloys. These improvements in properties are attributed to the finer Widmanstatten structure that exists in alloys having higher niobium content, and the retention of some of the high temperature beta phase. However, because niobium is a beta stabilizer, increasing the amount of niobium also depresses the beta transus temperature, and consequently the preferred working temperatures described in the present invention, which are described relative to the beta transus. The practical limit to the amount of niobium and other beta stabilizers is that the preferred working temperature relative to the beta transus may be so low that cracking during forging becomes a serious problem. The niobium content is preferably in the range of about 10 to about 16.5 percent, some of which may be replaced by molybdenum.

Molybdenum, which is also a beta stabilizer, behaves somewhat like niobium, except that its effect on retarding the transformation of beta to Widmanstatten alpha-2 is more pronounced. It is a potent strengthener, and it increases the creep resistance and elastic modulus of tri-titanium aluminides. However, such alloys having molybdenum greater than about 2.5 percent have very little ductility or toughness. The molybdenum content is preferably in the range of about 1 to about 2 percent.

The amounts of each of the beta stabilizers must be considered in conjunction with the amounts of the other beta stabilizers. It has been found that a tri-titanium aluminide consisting essentially of about 24.5 percent aluminum, 12.5 percent niobium and 1.5 percent molybdenum, balance titanium, provides a very desirable combination of properties, especially when the alloy is processed in accordance with the methods of the present invention. In the course of work leading to the present invention, it was found that vanadium, which is included in several prior art tri-titanium aluminides, reduces oxidation resistance of the alloy. A prior art tri-titanium aluminide containing about 3 percent vanadium oxidizes more than 20 times faster than the preferred alloy of the present invention at temperatures of about 650°-700° C. Thus, vanadium has been specifically omitted from the alloys of the present invention.

Contrary to prior art teachings which advocate both thermomechanical working and solution heat treatment above the beta transus, it has been found that better combinations of mechanical properties can be achieved if the thermomechanical working and solution heat treatment are conducted below the beta transus. This is referred to as sub-beta transus processing. The effectiveness of sub-beta transus processing is apparently traceable to the presence of a controlled amount of primary alpha-2 phase during both thermomechanical processing and heat treatment. Regions of primary alpha-2 serve to prevent the rapid growth of beta grains, which in turn limits the size of the alpha-2 formed during cooling and encourages the formation of the desirable Widmanstatten structure.

One form of sub-beta transus processing comprises heating the tri-titanium aluminide to a first temperature which is below the beta transus temperature. Although the actual temperature may vary, the preferred range is from about 40° C. to about 300° C. below the beta transus of the alloy.

The alloy is heated to the first processing temperature, and held there for a time sufficient to reach a reasonable approximation of phase equilibrium. The alloy is then worked at about this temperature. Working the alloy refines the alloy microstructure, and may be performed by any one of the several common methods for working alloys, provided that sufficient working is introduced into the work piece to evenly distribute the alpha-2 phase in a mixed microstructure of alpha-2 grains and beta matrix. The amount of working required in this process depends on several factors, such as strain rate, temperature and volume fraction of alpha-2, but it is generally greater than 50 percent reduction in area. Upon cooling, the beta transforms to Widmanstatten alpha-2 platelets. Some beta may be retained at room temperature. These methods of working include, but are not limited to, rolling, forging and extruding.

Figure 3:
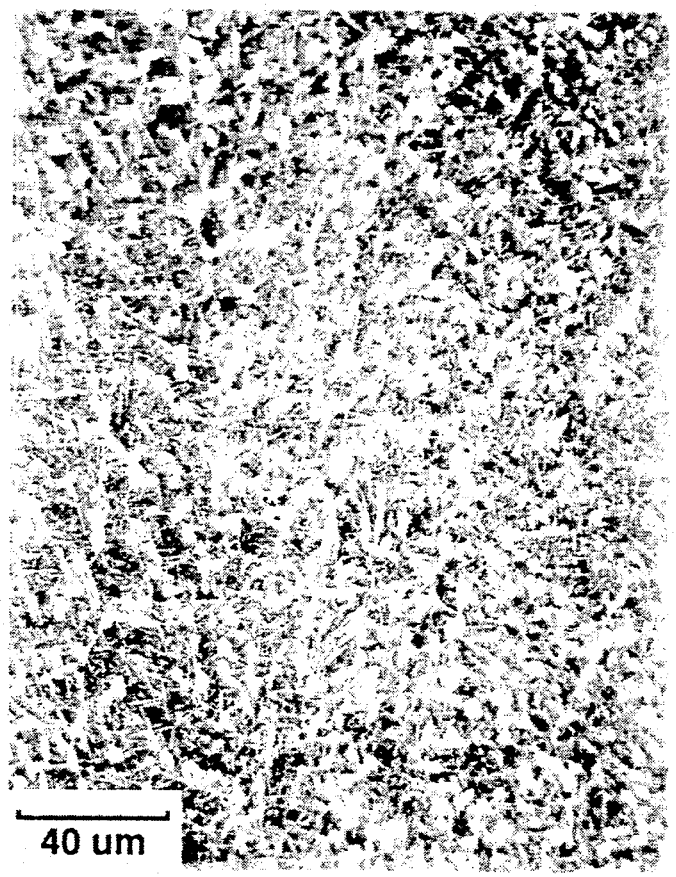
FIG. 3. Photomicrograph of Ti-24.5Al-12.5Nb-1.5Mo alloy heat treated at 1085° C. (about 40° C. below beta transus), and helium quenched. Microstructure comprises fine Widmanstatten structure with about 5 percent primary alpha-2 Magnification 500×.

After working the alloy, it is heat treated at a second temperature which is above the homogenizing and working temperature, but below the beta transus temperature. This post-processing heat treatment temperature is preferably selected to produce a microstructure having about 2 percent to about 20 percent primary alpha-2; the beta phase which coexists with the primary alpha-2 at elevated temperatures transforms to an alpha-2 Widmanstatten structure during cooling. This heat treatment produces the microstructure shown in FIG. 3.

Although it is more efficient to immediately heat treat the alloy after working and before it is allowed to cool, the same results may be obtained by allowing the alloy to cool and then subsequently heat treating the alloy at this second temperature. Particularly for the preferred Ti-24.5 Al-12.5 Nb-1.5 Mo alloy of the present invention, the preferred second temperature is about 15° C. to about 80° C. below the beta transus, with the most preferred temperature of about 30° C. below the beta transus, producing about 7 to 8 percent primary alpha-2.

Cooling from the post-processing heat treatment temperature should be performed at a rate selected to produce a microstructure having a balance of fine Widmanstatten platelets and alpha-2. The alpha-2 grains should be no greater than about 50 microns in size, and preferably between about 5 and 10 microns in size. The preferred cooling rate must be rapid enough to avoid formation of the colony structure shown in FIG. 2, yet slow enough to avoid excessive amounts of retained beta or the formation of a very fine metastable orthorhombic phase. For the alloys of the present invention, water or oil quenching, or quenching into a low temperature (below about 650° C.) salt bath result in excessively rapid cooling. Cooling in still air is too slow except for thin sections. The specific cooling rate that is most effective for a particular composition depends heavily on the amount of beta stabilizers in the alloy. In particular, molybdenum retards the beta decomposition, so that the preferred microstructure comprising primary alpha-2 and fine Widmanstatten structure, and possibly some small amount of retained beta, can be achieved with moderate cooling rates.

Tri-titanium aluminide alloys prepared in accordance with the sub-beta processing methods of the present invention have an improved combination of yield strength and room temperature ductility. This processing is effective in reducing the prior beta grain size. As a result, strain discontinuities at prior beta grain boundaries which are produced during loading are reduced, thus leading to increased ductility.

The mechanical properties obtained with the alloy and processing method of the present invention are illustrated in the Examples appended hereto. The improvements in tensile properties over the prior art which were achieved through the present invention are illustrated by comparing Examples 9, 14, 19 and 46–49 with Examples 5 and 50, which represent the prior art.

Although sub-beta transus processing may be used to improve the strength and ductility of most tri-titanium aluminide alloys, the improvements in strength and ductility of the alloys of the present invention when processed in accordance with the methods of the present invention are most dramatic. The alloys of the present invention are characterized by a fine Widmanstatten structure which results in improved strength and ductility. This improved strength and ductility is further enhanced by sub-beta transus processing.

In another embodiment of the present invention, a portion of the metal deformation process is performed above the beta transus temperature, but under carefully controlled conditions. It is important to keep the metal deformation temperature low enough, the time at temperature short enough, and the deformation rate and amount such that the deformed grains resulting from the process do not recrystallize to form equiaxed beta grains which might subsequently coarsen. In the manufacture of a disk forging for a gas turbine engine, for example, a billet of a tri-titanium aluminide alloy that had been previously processed to produce a grain size less than about 200 micrometers in diameter is first blocker forged at a temperature about 55° C. below its beta transus temperature. It is then finish forged at a temperature about 25° C. above its beta transus. It is then cooled quickly enough to develop a fine Widmanstatten structure that may contain as much as 10 percent retained beta. The process parameters are specifically chosen to minimize the formation of recrystallized beta grains prior to cooling. The disk forging is then optionally aged at about 700° C.

A back-to-back comparison of mechanical properties representing beta-forged and beta-heat treated material is shown by comparing Examples 1 and 5.

In yet another embodiment of the present invention, which is particularly applicable to rolling of sheet stock, a sheet bar is prepared by primary working below the beta transus. The sheet bar is then optionally heat treated above the beta transus sufficiently to develop a uniform fine grain beta structure, then air cooled to produce a fine Widmanstatten structure. The sheet bar is then rolled at a first temperature below the beta transus. Rolling is preferably started at about 50° C. to 100° C. below the beta transus, but the sheet may cool during rolling to about 225° C. below the beta transus. The sheet is optionally deformed by superplastic forming, which is not part of the present invention. The sheet is then heat treated at a second temperature below the beta transus, but higher than the first such temperature.

The tensile and creep test data presented in Tables 7–11 indicates that the second (solution) heat treatment temperature affects both yield strength and creep life, but in opposite directions. Creep life is increased by raising that temperature, but yield strength is increased by reducing that temperature, particularly when cooling from that temperature is slow. The best room temperature ductility was obtained at an intermediate temperature. Increasing the cooling rate from the second heat treatment temperature generally increased the strength of the alloy presumably because the Widmanstatten structure was finer. If the second heat treatment temperature was above the beta transus, as taught in the prior art, the creep life was greater, but the room temperature ductility was much lower than the values obtained with the alloy and method of the present invention.

EXAMPLES

A tri-titanium aluminide alloy having a nominal composition of Ti-24.5% Al-12.5% Nb-1.5% Mo was triple vacuum-arc-remelted and cast into an ingot approximately 450 mm in diameter. The beta transus of this material was found to be 1105° C.

In a first series of tests, the ingot was converted to approximately 150 mm diameter billet, first by conventional processing above the beta transus, then by working below the beta transus to refine the microstructure. Sections of this billet, 45 mm long, were pancake forged to 15 mm thickness. The forging and solution heat treatment temperatures employed in five different material conditions are listed in Table 1. After solution heat treatment, all samples were quenched into a salt bath at 815° C. for 30 minutes, and then aged 8 hours at 705° C. Specimens in material condition A were quenched into the salt bath directly from the forging operation.

TABLE 1

| Material Condition | Forging Temp. °C. | Solution Heat Treat Temp. °C. | Vol Percent Primary Alpha-2 |
|---|---|---|---|
| A | 1120 | None | 0 |
| B | 1040 | 1120 | 0 |
| C | 1040 | 1085 | 2 |
| D | 1040 | 1065 | 7 |
| E | 1040 | 1045 | 12 |

Tensile and creep specimens were cut from the pancake forgings described above. Results of tensile and creep tests are presented in Tables 2 and 3, respectively. Note that the values presented in Table 2 for elongation represent plastic deformation only, and not the sum of plastic and elastic deformation.

TABLE 2

| Example | Material Condition | Test Temp. °C. | 0.2% YS MPa | UTS MPa | Percent Elongation | Fracture Toughness MPa/m |
|---|---|---|---|---|---|---|
| 1 | A | 24 | 910 | 1081 | 3.2 | 15.0 |
| 2 | A | 425 | 742 | 1063 | 17.4 | |
| 3 | A | 540 | 749 | 974 | 12.9 | 91.3 |
| 4 | A | 650 | 727 | 903 | 11.6 | |
| 5 | B | 24 | 1035 | 1089 | 0.5 | 17.1# |
| 6 | B | 425 | 896 | 1040 | 3.1 | |
| 7 | B | 540 | 791 | 968 | 8.4 | 75.9 |
| 8 | B | 650 | 741 | 920 | 5.0 | |
| 9 | C | 24 | 792 | 972 | 3.1 | 18.8# |
| 10 | C | 425 | 595 | 896 | 21.8 | |
| 11 | C | 540 | 467 | 729 | 16.2 | 65.5 |
| 12 | C | 650 | 442 | 620 | 10.6 | |
| 13 | C | 650 | 680 | 833 | 6.8 | |
| 14 | D | 24 | 1051 | 1158 | 1.2 | 16.6# |
| 15 | D | 425 | 865 | 1087 | 14.9 | |
| 16 | D | 540 | 782 | 958 | 11.2 | 55.2 |
| 17 | D | 650 | 673 | 842 | 6.8 | |
| 18 | D | 650 | 776 | 987 | 3.9 | |
| 19 | E | 24 | 956 | 1096 | 2.5 | 19.0# |
| 20 | E | 425 | 739 | 992 | 18.0 | |
| 21 | E | 540 | 713 | 921 | 10.6 | 78.5 |
| 22 | E | 650 | 714 | 871 | 5.2 | |

Note:
# indicates valid $K_{Ic}$ measurement

TABLE 3

| Example | Material Condition | Test Temp. °C. | Creep Stress, MPa | Hours to 0.2% Creep |
|---|---|---|---|---|
| 23 | A | 540 | 448 | 87.0 |
| 24 | A | 595 | 379 | 17.7 |
| 25 | A | 650 | 172 | 19.8 |
| 26 | B | 540 | 448 | 114.0 |
| 27 | B | 595 | 379 | 14.1 |
| 28 | B | 650 | 172 | 33.0 |
| 29 | C | 540 | 414 | 95.0 |
| 30 | C | 595 | 276 | 34.0 |
| 31 | C | 650 | 172 | 10.9 |
| 32 | D | 540 | 414 | 40.0 |
| 33 | D | 595 | 276 | 34.0 |
| 34 | D | 650 | 172 | 8.8 |
| 35 | E | 540 | 414 | 22.0 |
| 36 | E | 595 | 276 | 12.9 |
| 37 | E | 650 | 172 | 7.5 |

In a second series of tests, another portion of the same ingot was converted to approximately 175 mm diameter billet, first by conventional processing above the beta transus, then by working below the beta transus to refine the microstructure. Sections of this billet were pancake forged to 45–50 mm thickness using the processing schedules presented as material conditions F and G in Table 4. Samples processed in condition H were made by flattening 74 mm diameter bar. After the indicated cooling process, all samples processed in conditions F, G or H were then aged 8 hours at 705° C. Specimens in material conditions G and H were quenched into the salt bath directly from the forging operation. The process taught by Blackburn and Smith, and their data, are indicated by material condition J.

TABLE 4

| Material Condition | Forging Temp. °C. | Reduction Ratio | Solution Heat Treat Temp. °C. | Cooling Process |
|---|---|---|---|---|
| F | 1040 | 2.6:1 | | |
| | 1125 | 3.1:1 | None | Air Cool |
| G | 1120 | 2.8:1 | None | 815° C. Salt |
| H | 1040 | 2.0:1 | 1080 | 815° C. Salt |
| J | 1120 | 7.0:1 | None | Unknown |

Tensile and creep specimens were cut from the forgings described above. Results of tensile and creep tests are presented in Tables 5 and 6, respectively.

TABLE 5

| Example | Material Condition | Test Temp. °C. | 0.2% YS MPa | UTS MPa | Percent Elongation |
|---|---|---|---|---|---|
| 38 | F | 24 | 796 | 951 | 1.8 |
| 39 | F | 24 | 796 | 943 | 1.8 |
| 40 | F | 24 | 726 | 917 | 2.2 |
| 41 | F | 24 | 710 | 909 | 2.7 |
| 42 | G | 24 | 771 | 918 | 1.8 |
| 43 | G | 24 | 811 | 966 | 2.1 |
| 44 | G | 24 | 705 | 902 | 2.9 |
| 45 | G | 24 | 735 | 922 | 2.6 |
| 46 | H | 24 | 900 | 1081 | 3.3 |
| 47 | H | 24 | 848 | 1070 | 5.0 |
| 48 | H | 24 | 886 | 1098 | 4.7 |
| 49 | H | 24 | 795 | 1058 | 6.7 |
| 50 | J | 25 | 825 | 1047 | 2.2 |
| 51 | J | 260 | 831 | 1058 | 9.2 |
| 52 | J | 427 | 729 | 950 | 12.1 |
| 53 | J | 538 | 647 | 967 | 9.2 |
| 54 | J | 650 | 640 | 835 | 9.1 |

TABLE 6

| Example | Material Condition | Test Temp. °C. | Creep Stress, MPa | Hours to 0.2% Creep |
|---|---|---|---|---|
| 55 | F | 593 | 248 | 201 |
| 56 | F | 593 | 248 | 140 |
| 57 | G | 593 | 248 | 132 |
| 58 | G | 593 | 248 | 258 |
| 59 | H | 593 | 248 | 53 |
| 60 | H | 593 | 248 | 58 |
| 61 | J | 593 | 413 | 27 |
| 62 | J | 650 | 380 | 2.8 |
| 63 | J | 650 | 380 | 1.4 |

In a third series of tests, another portion of the same ingot was converted to sheet bar, then rolled to approximately 2 mm thickness. Rolling was started at about 80° C. below the beta transus, and the material was periodically reheated between rolling passes, as required. After rolling, specimens were cut from the sheet, and heat treated, using the processes described in Table 7. All sheet specimens were then aged 8 hours at 705° C.

TABLE 7

| Material Condition | Solution Heat Treat Temp. °C. | Cooling Rate °C./min |
|---|---|---|
| K | 1085 | 11 |
| L | 1065 | 11 |

TABLE 7-continued

| Material Condition | Solution Heat Treat Temp. °C. | Cooling Rate °C./min |
|---|---|---|
| M | 1045 | 11 |
| N | 1025 | 11 |
| P | 1065 | 2.8 |
| Q | 1065 | 28 |
| R | 1120 | 11 |

Tensile and creep specimens were cut from the sheet described above. Results of tensile and creep tests are presented in Tables 8 and 9, respectively. All test specimens were cut parallel to the rolling direction of the sheet.

TABLE 8

| Example | Material Condition | Test Temp. °C. | 0.2% YS MPa | UTS MPa | Percent Elongation |
|---|---|---|---|---|---|
| 64 | K | 24 | 643 | 939 | 6.6 |
| 65 | K | 425 | 502 | 944 | 30.1 |
| 66 | K | 540 | 452 | 816 | 22.8 |
| 67 | K | 650 | 430 | 667 | 14.9 |
| 68 | L | 24 | 683 | 1010 | 9.1 |
| 69 | L | 425 | 522 | 975 | 32.3 |
| 70 | L | 540 | 502 | 835 | 20.1 |
| 71 | L | 650 | 461 | 671 | 16.6 |
| 72 | M | 24 | 740 | 989 | 6.4 |
| 73 | M | 425 | 573 | 996 | 30.2 |
| 74 | M | 540 | 546 | 849 | 18.0 |
| 75 | M | 650 | 490 | 669 | 20.6 |
| 76 | N | 24 | 798 | 1031 | 7.1 |
| 77 | N | 425 | 608 | 991 | 31.7 |
| 78 | N | 540 | 565 | 849 | 23.1 |
| 79 | N | 650 | 488 | 642 | 24.1 |
| 80 | P | 24 | 660 | 932 | 7.8 |
| 81 | P | 425 | 494 | 934 | 34.2 |
| 82 | P | 540 | 470 | 793 | 23.1 |
| 83 | P | 650 | 425 | 622 | 22.2 |
| 84 | Q | 24 | 734 | 1025 | 7.7 |
| 85 | Q | 425 | 572 | 1007 | 30.2 |
| 86 | Q | 540 | 543 | 875 | 22.5 |
| 87 | Q | 650 | 508 | 711 | 16.5 |
| 88 | R | 24 | 695 | 918 | 2.5 |
| 89 | R | 540 | 510 | 834 | 12.3 |
| 90 | R | 650 | 482 | 691 | 6.9 |

TABLE 9

| Example | Material Condition | Test Temp. °C. | Creep Stress, MPa | Hours to 0.2% Creep |
|---|---|---|---|---|
| 91 | K | 480 | 414 | 86.0 |
| 92 | K | 540 | 276 | 144.0 |
| 93 | K | 650 | 138 | 13.0 |
| 94 | L | 480 | 414 | 176.0 |
| 95 | L | 540 | 276 | 115.0 |
| 96 | L | 650 | 138 | 13.0 |
| 97 | M | 480 | 414 | 48.0 |
| 98 | M | 540 | 276 | 23.0 |
| 99 | M | 650 | 138 | 3.4 |
| 100 | N | 480 | 379 | 134.0 |
| 101 | N | 540 | 276 | 31.0 |
| 102 | N | 650 | 138 | 1.2 |
| 103 | P | 540 | 276 | 70.0 |
| 104 | P | 650 | 138 | 4.7 |
| 105 | Q | 480 | 414 | 303.0 |
| 106 | Q | 540 | 276 | 105.0 |
| 107 | Q | 650 | 138 | 8.4 |
| 108 | R | 540 | 414 | 232.0 |
| 109 | R | 650 | 138 | 245.0 |

In a fourth series of tests, the sheet bar was given a beta heat treatment prior to rolling. Otherwise, these specimens were prepared in the same way as those described in Table 7. Results of tensile and creep tests are presented in Tables 10 and 11, respectively. All test specimens were cut parallel to the rolling direction of the sheet.

TABLE 10

| Example | Material Condition | Test Temp. °C. | 0.2% YS MPa | UTS MPa | Percent Elongation |
|---|---|---|---|---|---|
| 110 | L | 24 | 751 | 961 | 5.4 |
| 111 | L | 425 | 571 | 969 | 26.6 |
| 112 | L | 540 | 567 | 821 | 11.8 |
| 113 | L | 650 | 529 | 686 | 6.7 |

TABLE 11

| Example | Material Condition | Test Temp. °C. | Creep Stress, MPa | Hours to 0.2% Creep |
|---|---|---|---|---|
| 114 | L | 480 | 414 | 754.0 |
| 115 | L | 540 | 276 | 249.0 |
| 116 | L | 650 | 138 | 19.0 |

In light of the foregoing discussion and Examples it will be apparent to those skilled in the art that the present invention is not limited to the embodiments, methods and compositions herein descried. Numerous modifications, changes, substitutions and equivalents will now become apparent to those skilled in the art, all of which fall within the scope contemplated by the invention.

I claim:

1. A tri-titanium aluminide alloy having improved room temperature ductility consisting essentially of, in atomic percent, about 22.5 percent to less than 25 percent aluminum, about 1 percent to about 2 percent molybdenum, about 10 percent to about 15 percent niobium, and the balance essentially titanium, wherein the alloy has a mixed microstructure comprising uniformly distributed grains of a primary alpha-2 phase and alpha-2 Widmanstatten platelets.

2. The tri-titanium aluminide alloy of claim 1, wherein the grains of the primary alpha-2 phase are no larger than about 50 microns in size.

3. The tri-titanium aluminide alloy of claim 1, wherein the volume percent of the primary alpha-2 phase is from about 2 percent to about 20 percent.

4. The tri-titanium aluminide alloy of claim 1, wherein the ally has the mixed microstructure developed through a method of processing comprising the steps of:

heating the alloy to a first temperature in the range of from about 40° C. to about 300° C. below a beta transus of the ally;

while holding the alloy at about the first temperature, working the alloy sufficiently so that its microstructure is refined and the primary alpha-2 phase is uniformly distributed throughout the microstructure;

heat treating the worked alloy at a second temperature above the first temperature and below the beta transus temperature and for a period of time sufficient to retain about 2 percent to about 20 percent of the primary alpha-2 phase; and cooling the worked alloy from the second temperature at a rate sufficient to produce the mixed microstructure.

5. The tri-titanium aluminide alloy of claim 4, wherein the first temperature is from about 40° C. to about 220° C. below the beta transus.

6. The tri-titanium aluminide alloy of claim 4, wherein the second temperature is greater than the first temperature and at least 30° C. below the beta transus.

7. The tri-titanium aluminide alloy of claim 4, wherein the step of working is accomplished by using an operation selected from the group of forging, cogging, rolling, extruding and swaging.

8. A tri-titanium aluminide alloy having improved room temperature ductility consisting essentially of, in atomic percent, about 22.5 percent to less than 25 percent aluminum, about 1 percent to about 2 percent molybdenum, about 10 percent to about 15 percent niobium, and the balance essentially titanium, wherein the alloy having a microstructure comprising alpha-2 Widmanstatten platelets which is developed through a method of processing comprising the steps of:

heating the alloy to a first temperature from about 40° C. to about 300° C. below a beta transus of the alloy; then working the alloy sufficiently so that its microstructure is refined and a primary alpha-2 phase is uniformly distributed throughout the microstructure; then heating the alloy to a second temperature from about 25° C. to about 40° C. above the beta transus of the alloy to produce a substantially fully beta structure;

further working the alloy to deform the beta grains;

cooling the alloy quickly enough so that less than about 20 percent by volume of the beta phase recrystallizes and so that a fine Widmanstatten structure substantially without primary alpha-2 is produced; and then optionally aging the alloy at a third temperature in the range of from about 650° to about 700° C.

9. The tri-titanium aluminide alloy of claim 8, wherein the first temperature is from about 40° C. to about 165° C. below the beta transus.

10. A tri-titanium aluminide alloy having improved room temperature ductility consisting essentially of, in atomic percent, about 22.5 percent to less than 25 percent aluminum, about 1 percent to about 2 percent molybdenum, about 10 percent to about 15 percent niobium, and the balance essentially titanium, wherein the alloy having a mixed microstructure comprising alpha-2 Widmanstatten platelets which is developed through a method of processing comprising the steps of heating the alloy to a first temperature in the range of from about 40° C. to about 300° C. below a beta transus of the alloy; then working the alloy sufficiently so that its microstructure is refined and a primary alpha-2 phase is uniformly distributed through the microstructure; then heating the alloy to a second temperature in the range of from about 25° C. to about 40° C. above the beta transus of the alloy to produce a substantially fully beta structure; then cooling the alloy quickly enough so that a fine Widmanstatten structure substantially without primary alpha-2 is produced; followed by heating the alloy to a third temperature, in the range of from 40° C. to about 220° C. below the beta transus of the alloy; then rolling the alloy into sheet configuration; and then heating the alloy to a fourth temperature, below the beta transus of the alloy and above the third temperature.

11. The tri-titanium aluminide alloy of claim 10, wherein the first temperature is from about 40° to about 165° C. below the beta transus.

* * * * *